US010851612B2

(12) United States Patent
Al-Gouhi et al.

(10) Patent No.: US 10,851,612 B2
(45) Date of Patent: Dec. 1, 2020

(54) WELLBORE ZONAL ISOLATION

(71) Applicant: Saudi Arabian Oil Company, Dhahran (SA)

(72) Inventors: Alwaleed Abdullah Al-Gouhi, Dhahran (SA); Mohamed Nabil Noui-Mehidi, Dhahran (SA); Qais Mohammad Al Hennawi, Khobar (SA); Fadhil N. Alsayegh, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 170 days.

(21) Appl. No.: 16/121,201

(22) Filed: Sep. 4, 2018

(65) Prior Publication Data

US 2020/0072016 A1 Mar. 5, 2020

(51) Int. Cl.

| | |
|---|---|
| ***E21B 33/12*** | (2006.01) |
| ***E21B 23/06*** | (2006.01) |
| ***E21B 43/10*** | (2006.01) |
| *E21B 43/14* | (2006.01) |

(52) U.S. Cl.

CPC ..... *E21B 33/1208* (2013.01); *E21B 23/06* (2013.01); *E21B 43/105* (2013.01); *E21B 43/14* (2013.01)

(58) Field of Classification Search

CPC .. E21B 33/1208; E21B 33/138; E21B 21/003; E21B 23/06; E21B 43/105

See application file for complete search history.

(56) References Cited

U.S. PATENT DOCUMENTS

| | | | | |
|---|---|---|---|---|
| 2,804,148 | A | 8/1957 | Schremp et al. | |
| 3,302,717 | A | 2/1967 | West et al. | |
| 3,354,955 | A | 11/1967 | Berry | |
| 3,419,080 | A | 12/1968 | Lebourg | |
| 3,525,398 | A | 8/1970 | Fisher | |
| 3,762,476 | A | 10/1973 | Gall | |
| 4,163,770 | A | 8/1979 | Porosoff | |
| 4,508,389 | A * | 4/1985 | Hodges | E21B 7/18 166/245 |
| 4,572,295 | A | 2/1986 | Walley | |
| 4,817,721 | A | 4/1989 | Pober | |
| 5,161,615 | A | 11/1992 | Hutchins et al. | |
| 5,741,293 | A | 4/1998 | Wijay | |
| 6,102,120 | A | 8/2000 | Chen et al. | |

(Continued)

FOREIGN PATENT DOCUMENTS

| | | |
|---|---|---|
| WO | 2018057361 | 3/2018 |
| WO | 2018098303 | 5/2018 |

OTHER PUBLICATIONS

International Search Report and Written Opinion issued in International Application No. PCT/US2019/049285 dated Feb. 19, 2020, 21 pages.

(Continued)

*Primary Examiner* — D. Andrews

(74) *Attorney, Agent, or Firm* — Fish & Richardson P.C.

(57) ABSTRACT

A system and method for sealing permeability of a wellbore zone, including deploying a sealing assembly into the wellbore zone. The sealing assembly includes an expandable metal structure and polymer disposed on the expandable metal structure. The metal structure and polymer are expanded against a wall of the wellbore zone to plug the permeability.

22 Claims, 6 Drawing Sheets

(56) References Cited

U.S. PATENT DOCUMENTS

| | | | | |
|---|---|---|---|---|
| 6,431,282 | B1 | 8/2002 | Bosma et al. | |
| 6,452,068 | B1 | 9/2002 | Zuo et al. | |
| 6,540,777 | B2 | 4/2003 | Stenzel | |
| 6,672,385 | B2 | 1/2004 | Kilaas et al. | |
| 6,834,725 | B2 | 12/2004 | Whanger et al. | |
| 7,357,189 | B2 | 4/2008 | Aldaz et al. | |
| 7,380,595 | B2 | 6/2008 | Wetzel et al. | |
| 7,665,537 | B2 | 2/2010 | Patel et al. | |
| 8,523,936 | B2 | 9/2013 | Schmid et al. | |
| 2004/0144535 | A1 | 7/2004 | Kalman et al. | |
| 2005/0155773 | A1* | 7/2005 | Wetzel | E21B 43/108 166/381 |
| 2009/0178809 | A1 | 7/2009 | Jeffryes et al. | |
| 2012/0055667 | A1 | 3/2012 | Ingram et al. | |
| 2013/0220641 | A1 | 8/2013 | Fripp et al. | |
| 2014/0299331 | A1 | 10/2014 | Hart et al. | |
| 2015/0267501 | A1 | 9/2015 | Al-Gouhi | |
| 2018/0112490 | A1 | 4/2018 | Al-Gouhi et al. | |

OTHER PUBLICATIONS

Invitation to Pay Additional Fees and, Where Applicable, Protest Fee issued in International Application No. PCT/US2019/049285 dated Dec. 11, 2019, 13 pages.

Saltel et al., "In-Situ Polymerisation of an Inflatable Composite Sleeve to Reline Damaged Tubing and Shut-Off Perforation," SPE 8202, presented at the Offshore Technology Conference, May 6-9, 1996, 9 pages.

ceramicindustry.com' [online], "Microwave Heating of Ceramics," Oct. 1, 2015, [retrieved on May 15, 2018], retrieved from URL: <https://www.ceramicindustry.com/articles/95044-microwave-heating-of-ceramics>, 4 pages.

* cited by examiner

WELLBORE ZONAL ISOLATION

TECHNICAL FIELD

This disclosure relates to wellbore zonal isolation including sealing a wellbore zone with polymer.

BACKGROUND

A borehole or wellbore may be drilled into a hydrocarbon formation or reservoir in the Earth for the exploration or production of oil and gas. An example of a problematic section of a wellbore is a water zone in which water enters the wellbore from the hydrocarbon formation or underlying water aquifer. The influx of water into the wellbore during drilling and during the subsequent production of oil and gas can add cost. Indeed, the production of water along with the oil and gas from the hydrocarbon formation can lead to surface processing of the water and injection of the water back into the hydrocarbon formation for disposal or pressure maintenance. Such processing and injection of water produced from the wellbore water zone unfortunately causes increased costs of the oil and gas production.

SUMMARY

An aspect relates to a sealing assembly for a zone of a wellbore, including a setting tool for rigless deployment of the sealing assembly into the wellbore, the setting tool having extendable arms. The sealing assembly includes ratchet rings disposed on the extendable arms and expandable to a diameter of the wellbore. Further, the sealing assembly includes an expandable metal structure disposed around the ratchet rings. A polymer disposed on the expandable metal structure may plug permeability of the wellbore zone.

Another aspect relates to an oil-well intervention system for a wellbore zone, including a sealing assembly to seal the wellbore zone. The sealing assembly includes a setting tool for rigless deployment of the sealing assembly into the wellbore, the setting tool having hydraulic extendable arms. The sealing assembly includes ratchet rings disposed on the hydraulic arms, the ratchet rings expandable to a diameter of the wellbore zone and to lock in place in an expanded state. In addition, the sealing assembly includes an expandable metal structure disposed on the ratchet rings. The system includes a flexible polymer sleeve disposed around an outer surface of the expandable metal structure.

Yet another aspect relates to a method of sealing permeability of a wellbore water zone, including deploying a sealing assembly into the wellbore water zone, wherein the sealing assembly includes an expandable metal structure and polymer disposed on the expandable metal structure. The method includes expanding, via a hydraulic cylinder, the expandable metal structure and polymer against a wall of the wellbore water zone. Further, the method includes heating the expandable metal structure as expanded to melt the polymer against the wall of the wellbore water zone.

The details of one or more implementations are set forth in the accompanying drawings and the description below. Other features and advantages will be apparent from the description and drawings, and from the claims.

DETAILED DESCRIPTION

Some aspects of the present disclosure are directed to sealing a wellbore section with a polymer or elastomer. In examples, the wellbore section is a water zone of the wellbore. In examples, the wellbore or the wellbore section may be a borehole or open hole generally without a casing. The applied polymer may damage the formation. In other words, the applied polymer may plug permeability or fractures in the wellbore section such that entry of fluid (for example, water) from the hydrocarbon formation into the wellbore at that wellbore section (for example, water zone) is reduced or prevented.

In one example, a polymer and an expandable metallic structure are deployed to the target depth of an open-hole by coil tubing and a setting tool with several sets of hydraulic arms, as explained below. The polymer may be a polymer mass or flexible polymer envelope on the expandable metallic structure. The polymer may generally be cylindrical in shape around the metallic structure. An electrical current may heat the metallic structure to melt the cylinder polymer against the well wall to generate formation damage to the undesirable water zone in a hydrocarbon producer well. Thus, a rig operation to isolate the water zone may be avoided.

As discussed below, a sealing assembly may include an expandable metal structure residing on ratchet rings. The sealing assembly may include the ratchet rings coupled to hydraulic arms of a setting tool. The expandable metal structure may include a stent, wire mesh, wire linkage, flexible sheet, expandable cylinder, and the like. The expandable metal structure including the underling ratchet rings may be lowered into the wellbore via the setting tool and expanded via the setting tool. The underlying ratchet rings may expand and support the metal structure having polymer disposed thereon to plug or seal permeability in the formation.

Indeed, a sealing polymer mass or sleeve may reside on an outer surface of the expandable metal structure. In operation, the sealing assembly may expand the ratchet rings and thus expand the metal structure to press the polymer against the wall of the wellbore. Electrical current may be applied to heat the metal structure to melt the polymer to plug or block permeability in the wellbore section being sealed. After sealing, the setting tool having the hydraulic arms may be removed from the wellbore, leaving the ratchet rings and metal structure in place in the expanded state along with the sealing polymer against the wall of the wellbore.

Figure 1:
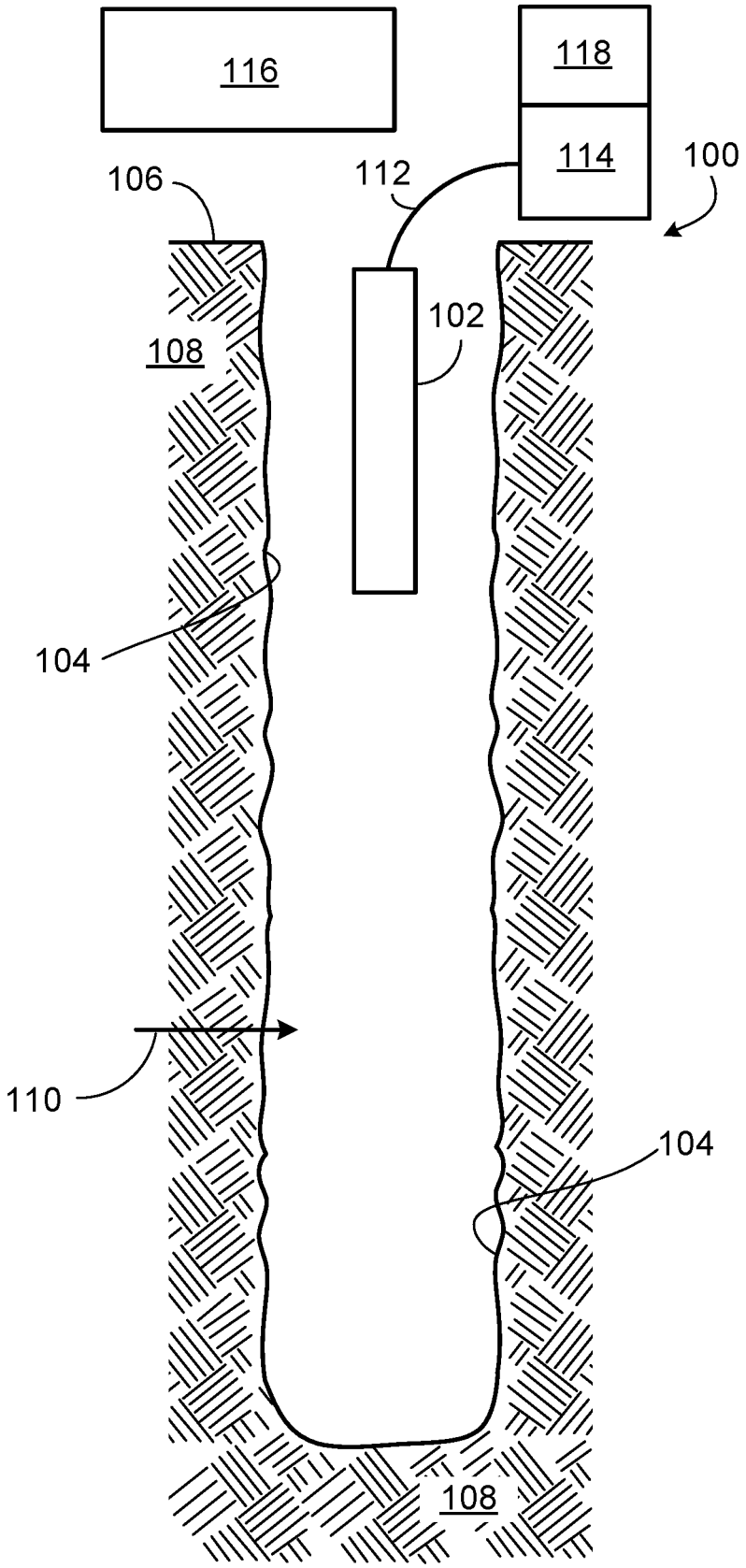
FIG. 1 is a diagram of a drill site including a drill bit disposed in a hole in an Earth formation.

FIG. 1 is a drill site 100 which may be a location for oil exploration and production activities. As discussed below, a sealing assembly 102 may be lowered into an open-hole wellbore 104 (borehole) to plug formation permeability in a problematic section of the wellbore 104 such as a water zone. In an example, the sealing assembly 102 having a cylindrical shape made of polymer and an underlying expandable metallic structure is deployed to the target depth of an open-hole by coil tubing and a setting tool having several sets of hydraulic arms. Of course, the drill string may be removed from the wellbore 104 before deploying the sealing assembly 102. An electrical current is applied to heat the metallic structure which can be made of heating-element type alloys in typical heating applications. The heated metallic structure may melt the cylinder polymer against the well wall to a temperature to bind the melted polymer to the borehole sand face. This polymer film or envelope may cover the well portion where a water invasion occurred for instance, and stops or reduces water from entering the wellbore. This formation damage to the undesirable water zone accomplished by the polymer skin may be beneficial in a hydrocarbon producer well to eliminate or reduce water production. Thus, in examples, an expensive rig operation to isolate the water zone is avoided.

The drill site 100 may form (drill) a borehole or wellbore 104 in the ground for the exploration or extraction of a natural resource such as crude oil or natural gas. The drill site 100 may be a workplace and have equipment to drill an oil or gas well and establish associated infrastructure such as a wellhead platform. The drill site 100 may include a mounted drilling rig which is a machine that creates holes in the Earth subsurface. The term "rig" may refer to equipment employed to penetrate the surface of the Earth's crust. Oil and natural-gas drilling rigs create holes to identify geologic reservoirs and that allow for the extraction of oil or natural gas from those reservoirs. To form a hole in the ground, a drill string having a drill bit may be lowered into the hole being drilled. In operation, the drill bit may rotate to break the rock formations to form the hole as a wellbore 104. In the rotation, the drill bit may interface with the ground or formation to grind, cut, scrape, shear, crush, or fracture rock to drill the hole. The hole or wellbore 104 diameter may be in a range from about 3.5 inches (8.9 centimeters) to 30 inches (76 centimeters), or outside of this range. In examples, the wellbore 104 is at least 6⅛ inches openhole. The depth of the borehole or wellbore 104 can range from 1,000 feet (300 meters) to more than 30,000 feet (9,100 meters).

The open-hole wellbore 104 is drilled and formed through the Earth surface 106 into a hydrocarbon formation 108. In operation, a drilling fluid (also known as drilling mud) is circulated down the drill string to the bottom of the wellbore 104. The drilling fluid may then flow upward toward the surface 106 through an annulus formed between the drill string and the wall of the wellbore 104. The drilling fluid may cool the drill bit, apply hydrostatic pressure upon the formation penetrated by the wellbore 104, and carry formation cuttings to the surface 106, and so forth. Lastly, during application of the aforementioned sealing assembly 102, the drill string may be removed or not in the wellbore 104.

An example of a problematic section of the wellbore 104 is a water zone. The water may enter at a water zone that may include a permeable or fractured interface of the hydrocarbon formation 108 with the wellbore 104. As indicated, a wellbore zone may be a section of the wellbore having a length. In the illustrated embodiment, the sealing assembly 102 is deployed to a water zone of the wellbore 104 in which water 110 undesirably enters the wellbore 104 from the hydrocarbon formation 108. The sealing assembly 102 may be lowered in a collapsed mode into the wellbore 104.

For rigless operation, the sealing assembly 102 may be lowered into the wellbore 104 via a deployment extension 112 from a dispenser 114. In one example, the deployment extension 112 is coiled tubing and the dispenser 114 is a coiled tubing reel. Coiled tubing is commonly employed in oil and gas operations. In another example, the deployment extension 112 is a wireline or cable and the dispenser 114 is a wireline truck which is also commonly employed in oil and gas operations. Thus, the deployment of the sealing assembly 102 into the wellbore may be rigless. A rigless operation may be a well intervention conducted with equipment and support facilities that preclude the requirement for a rig over the wellbore. Coiled tubing and wireline applications may be rigless.

In general, the deployment extension 112 may be a conduit, coiled tubing, wireline, slickline, and the like, for rigless deployment including lowering equipment into the wellbore 104 and raising or pulling (retrieving) equipment from the wellbore 104. The dispenser 114 may be a conduit dispenser, and the deployment extension 112 a conduit such as flexible pipe or coiled tubing. The dispenser 114 may be a wire or cable dispenser, and the deployment extension 112 a wire or cable, and so forth.

The drill site 100 typically has a drilling rig including equipment discussed above and includes surface equipment 116 such as tanks, pits, pumps, and piping for circulating drilling fluid (mud) through the wellbore 104. Settling equipment or a separation vessel, such as a shale shaker, may receive a slurry of the drilling fluid and rock cuttings from the wellbore 104. The shale shaker may separate rock cuttings from the drilling fluid. Pits may collect removed rock cuttings. The drilling rig or surface equipment 116 may include a derrick, Kelly drive, top drive, rotary table, drill floor, and additional equipment, components, or features. A mobile laboratory onsite may test the drilling fluid or rock cuttings. Temporary housing may be provided at the drill site 100 for operating personnel, and the like.

The sealing assembly 102 may include or be coupled to an electricity source 118 or electromagnetic radiation source, or both. The electricity source 118 may apply electricity through the deployment extension 112 and sealing assembly 102 for electrical heating. The electricity source 108 may be a power source, an electrical outlet, a generator, a typical electricity source at the drill site 100, and so on. In one example, an electrical cable or line is run from the electricity source 118 to the sealing assembly 102 including its expandable metal structure to be heated.

The electricity may heat the expandable metal structure of the sealing assembly 102 and thus melt the polymer disposed on the outer surface of the metal structure at the interface with the wellbore 104 wall. The melted polymer may fill pores or fractures in the formation 108 and harden or solidify for formation 108 damage to seal the permeability in the formation 108.

The electrical current may be routed in or along the deployment extension 112 from the electricity source 118 via an electrical cable or wire. As mentioned, the deployment extension 112 may be coiled tubing, cable, or wire, and the like. In some implementations, an electrical current may flow through an electrical wire or cable in the coiled tubing, or through wireline as an electrical wire or cable, or through an electrical cable or wire that is not the deployment extension 112.

In other examples, the metal structure may include or is doped with metal ceramic particles or metal ceramic particles, and in operation, heated with microwave radiation to melt the polymer for formation 108 damage. The microwave radiation source may be deployed on or with the setting tool of the sealing assembly 102. In the case of relying on ceramic particles embedded in the metallic structure or mesh, the deployment setting tool may have a microwave heating element within or on the setting tool to radiate microwave energy to heat the embedded ceramics to heat the metal structure to melt the polymer or polymer cylinder. Heat may radiate from the ceramic.

As discussed, examples may include an expandable polymer mass, envelope, or sleeve that may be generally cylindrical disposed on an expandable metallic structure. The expandable metallic structure may also be generally cylindrical and with underlying ratchet rings. Again, the metallic structure may be or include a metal stent or mesh, or similar structure, and the supporting ratchet rings abutting the inner diameter of the metal stent or mesh. The metallic structure including ratchet rings may be deployed to a target depth of an open hole by a rigless operation (for example, coiled tubing) and the aforementioned hydraulic setting tool. The setting tool may have hydraulic arms to expand the metallic structure and polymer cylinder against the well wall. The metallic structure may lock in place when expanded to the well wall. In certain examples, the ratchet rings may be attached to the hydraulic arms of the setting tool via shear pin(s). Indeed, the ratchet rings may have holes to receive or fit with shearing pins on the hydraulic arms. In operation, the pins may be sheared to release the ratchet rings from the hydraulic arms and the setting tool.

An electrical current through the metallic structure, or microwave radiation of the metallic structure having ceramic particles, heats the polymer cylinder or mass to adhere the polymer to the well wall to plug (seal) the formation to isolate the zone (without a rig operation). In one example, the zone is an undesirable water zone in a hydrocarbon producer well. The deployment setting tool having the hydraulic arms may be removed. The metallic structure including the metal cylinder (e.g., mesh, stent, etc.) and expandable ratchet rings as expanded and locked in place may remain.

To deploy the metallic stent structure, the setting tool may have cascading sets of arms actuated by a hydraulic cylinder to install the metallic stent structure inside the wellbore to seal against the undesired zone. As discussed in more detail below, the arms have the capability to stretch or extend the ratchet rings. Once the ratchet rings as extended and applying adequate force or pressure against the metallic structure and the wall of the undesired zone, the hydraulic arms can shrink back to their original or collapsed position without the ratchet rings. The ratchet rings detach from the hydraulic arms. In other words, the setting tool releases the ratchet rings. The principle of operation of the hydraulic arms may be similar to the principle of operation of umbrella arms. As indicated, a hole-pin arrangement may facilitate the arm and the ring to expand together. However, when the arms are closing, the pins separate from the holes and the arms shrink alone facilitating the ratchet ring to remain stretched.

Figure 2A:
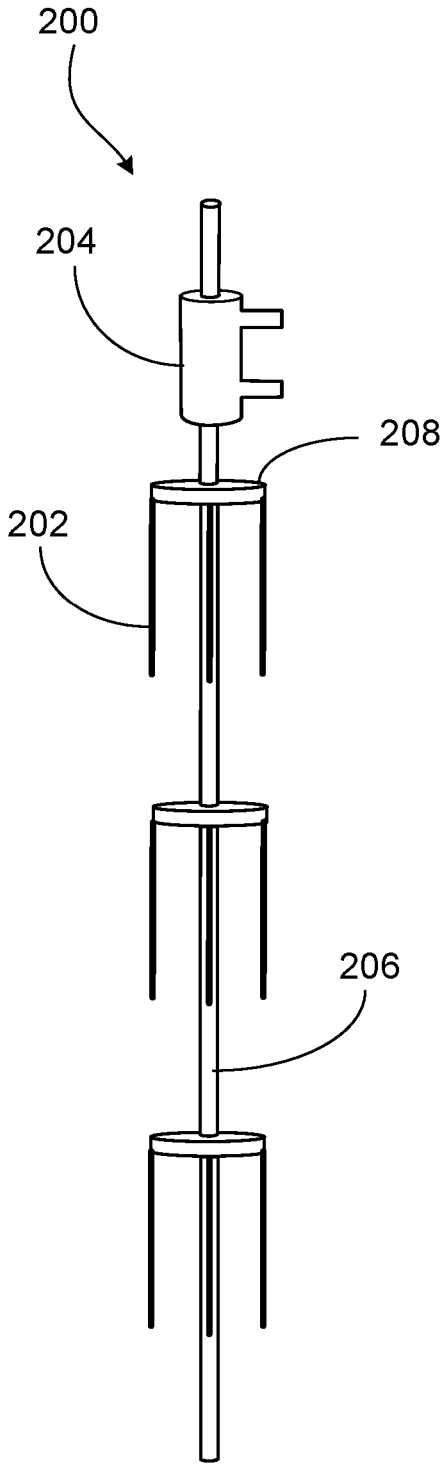
FIG. 2A is a diagram of a setting tool in a collapsed state.

FIG. 2A is a setting tool 200 that may be employed as the setting tool of the sealing assembly 102 of FIG. 1. The setting tool 200 is depicted in a collapsed mode in FIG. 2A. The setting tool 200 has arms 202 that may be actuated by a hydraulic cylinder 204. As discussed below, ratchet rings may be disposed on the ends of the arms 202. In particular, a respective ratchet ring may be temporarily coupled to each set of arms 202. The setting tool 200 has a body 206 and supports 208 along the body 206 for the arms 202. In the illustrated example, the supports 208 are ring-shaped. In operation, hydraulic fluid may flow from the hydraulic cylinder 204 through the body 206 and supports 208 to hydraulically activate or drive the arms 202 to extend the arms 202.

Figure 2B:
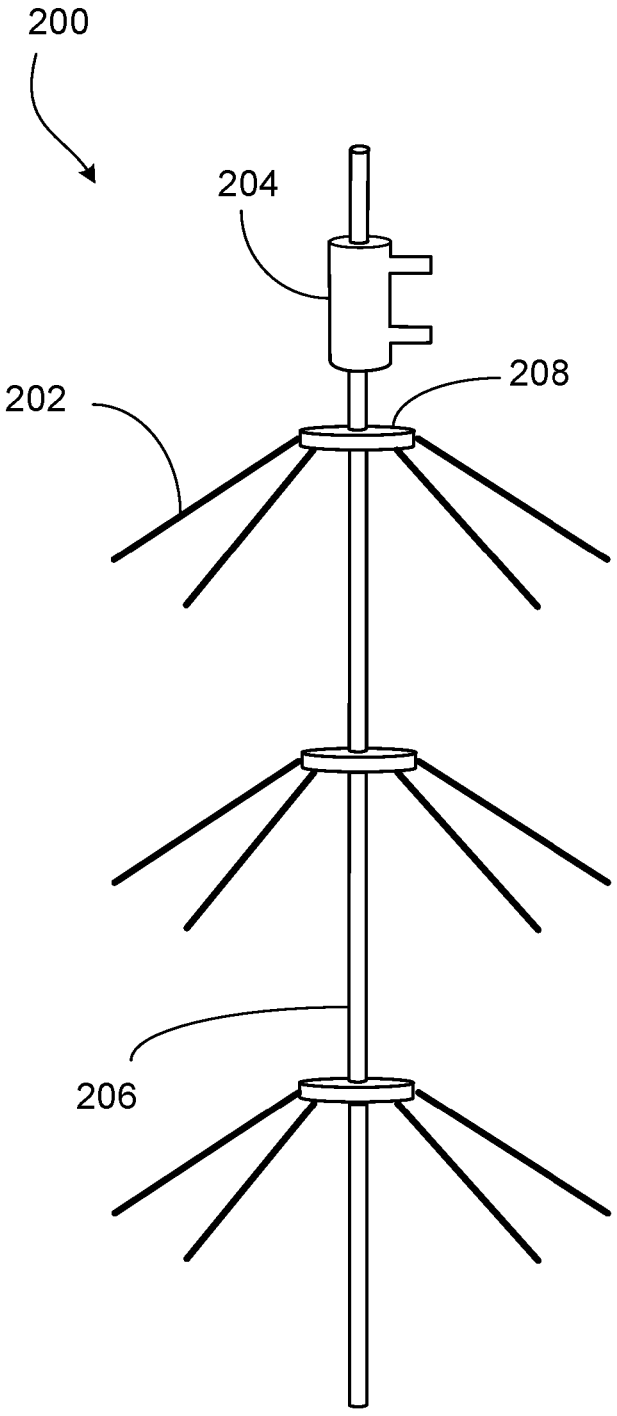
FIG. 2B is a diagram of the setting tool of FIG. 2A in an expanded state.

FIG. 2B is the setting tool 200 of FIG. 2A but in an expanded state via the hydraulic cylinder 204. The hydraulic cylinder 204 may be or associated with a hydraulic drive or hydraulic system. The hydraulic cylinder 204 may convert generated hydraulic energy back into mechanical energy. The hydraulic cylinder 204 may be connected through valves to a pump supplying hydraulic fluid. A hydraulic drive may be a quasi-hydrostatic drive or transmission system that employs pressurized hydraulic fluid to power equipment or tools. A hydraulic system may include a reservoir, pump or generator, valves, actuators, pistons, a hydraulic generator such as a pump, a hydraulic actuator such as a hydraulic motor or hydraulic cylinder to drive equipment, and so forth. The reservoir may hold the hydraulic fluid or liquid which can be synthetic fluids, petroleum-based fluids such as petroleum oil with additives, and the like. The pump if employed may move the fluid. The valves may direct where the fluid flows and may be actuated through electrical, manual, hydraulic, pneumatic, or mechanical actuators. Additional actuators such as a hydraulic drive actuator or the hydraulic cylinder 204 may convert the generated hydraulic energy back into mechanical energy for use. In the illustrated example of FIG. 2B, the hydraulic cylinder 204 may drive the extendable arms 202 of the setting tool.

Figure 2C:
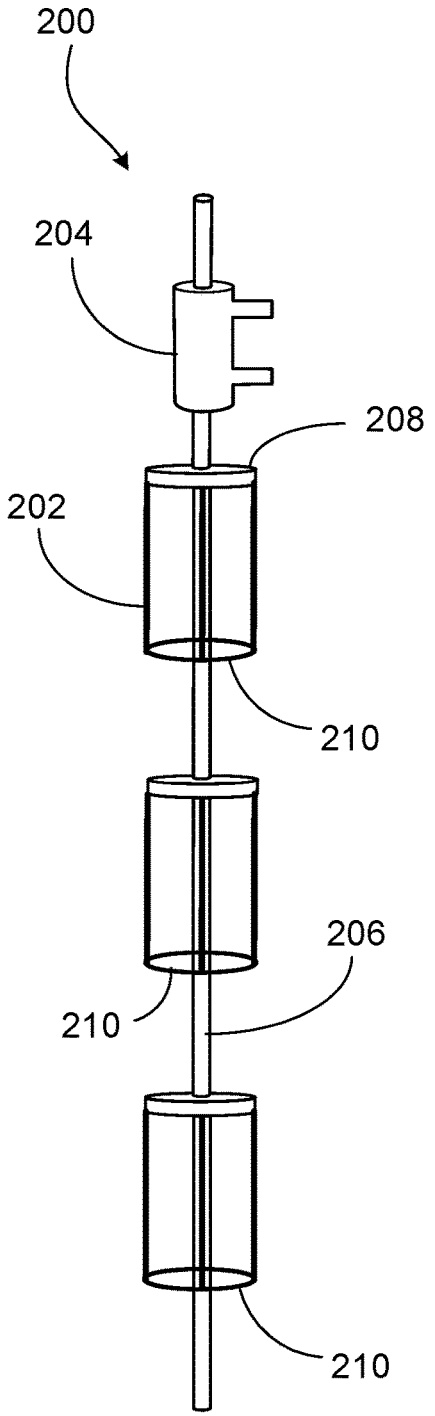
FIG. 2C is a diagram of the setting tool of FIG. 2A having ratchet rings disposed thereon.

FIG. 2C is the setting tool 200 in a collapsed mode as depicted in FIG. 2A but with ratchet rings 210 disposed thereon. The ratchet rings 210 are retracted. The ratchet rings 210 are connected (temporarily) to the hydraulic arms 202 of the deploying tool 200.

Figure 2D:
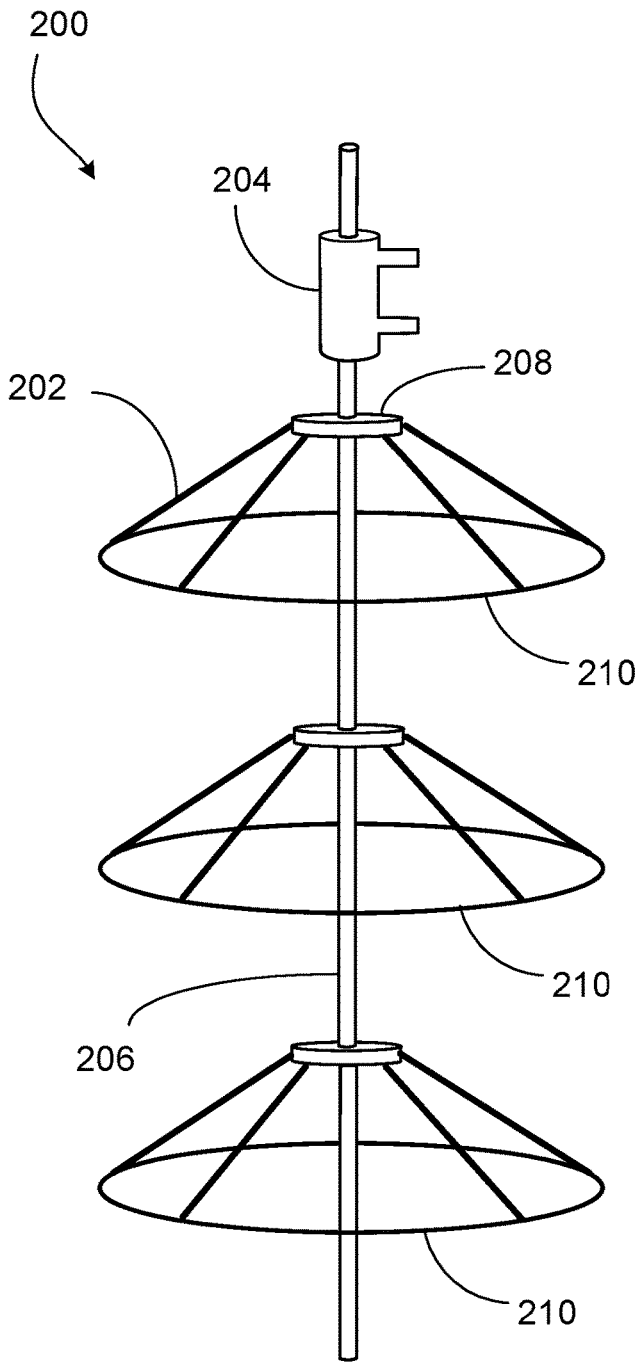
FIG. 2D is a diagram of the setting tool of FIG. 2B having ratchet rings disposed thereon.

FIG. 2D is the setting tool 200 in an expanded mode as depicted in FIG. 2B but with the ratchet rings 210 disposed thereon. The ratchet rings 210 are extended. The ratchet rings 210 will give a radial strength to the polymer cylinder (not shown but see FIG. 4). Once the arms are 202 expanded, the ratchet rings 210 will expand and the polymer cylinder will reach the borehole wall. The ratchet rings and metallic structure (see FIG. 3) may lock at the well wall. The ratchet rings 210 may include a pawl, detent, ratchet wheel, tooth wheel, ratch, latch, inclined teeth, etc. A pawl may prevent movement in one direction. In one example, the ratchet ring 210 is a toothed ratchet ring, as discussed below with respect to FIG. 6A.

Figure 3:
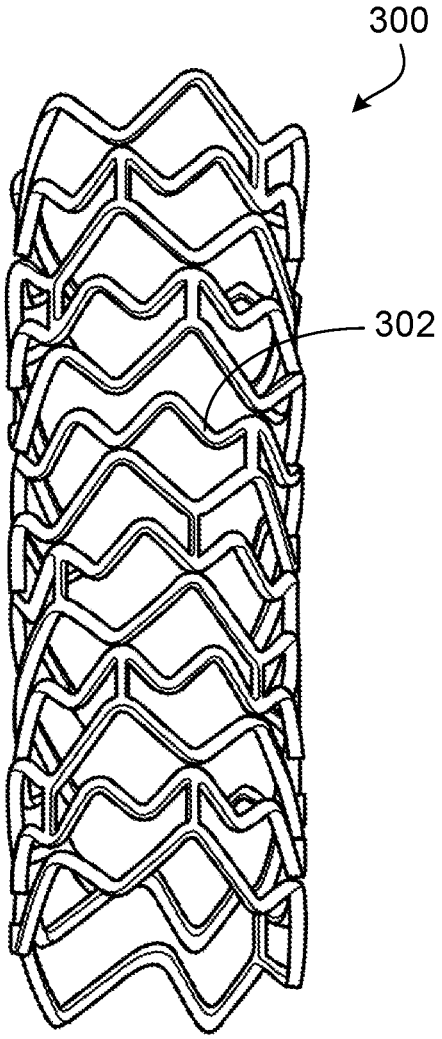
FIG. 3 is a diagram of an expandable metal structure of a sealing assembly.

FIG. 3 is an example of the expandable metal structure 300 (as a metal mesh or stent) of the sealing assembly 102 of FIG. 1. The metal structure 300 may be generally cylindrical. In some examples, a metal stent 300 may operate similar to a medical stent. The metal structure 300 or stent may have wires or linkages 302 that accommodate expansion of the structure 300 and facilitating maintaining or locking the metal structure as expanded. Some examples may be a slide-and-lock stent which has sliding lock members, or a stent including a lockable cell having locking members. Other examples may have locking features to prevent recoil such as rings staggered and aligned, and crossties as angled or straight.

The metal stent or expandable metal structure 300 may be placed on the ratchet rings 210 on the arms 202 (see preceding figures) of the sealing system 102. In some examples, the metal structure 300 may further include the ratchet rings 210. In other examples, the ratchet rings 210 may be characterized as not a component of the metal structure 300. The metal structure 300 as a metallic mesh or stent can be or incorporate metals that readily heat when subjected to electrical current. Examples of such metals include nichrome or nickel-chrome alloy, Kanthal® (an iron-chromium-aluminum alloy), cupronickel, or other metals. In some embodiments, ceramic particles are embedded in the metal structure 300 such as on the nodes of the metallic mesh. The ceramic particles can be heated by a microwave radiating tool deployed on the interior side of the expanded stent or mesh wire, which in certain examples could heat the meal structure 300 to 1000° C. or more.

Stents may be wire-like or mesh-like. Again, the metallic structure 300 (to be inside the polymer) may resemble a medical stent which has the capability of expansion to as much as twice its original size and can lock at its expanded state. Indeed, as discussed, the operation of examples of the expandable metal structure 300 may be similar in principle to operation of a medical stent in certain examples.

Thus, in examples, the expandable metal structure 300 may be based on medical stent principle of expansion and locking, and with heating capability. Once expanded, an electric current may be applied to the metallic structure 300 to heat the metal structure 300. In another embodiment, a microwave source is deployed to heat ceramic particles embedded in the metal structure 300 (metallic mesh) to generate heat to melt the cylindrical polymer (see FIG. 4) disposed thereon and for the polymer to adhere to the wellbore 104 wall by taking the shape of the wellbore 104 (borehole) wall.

Figure 4:
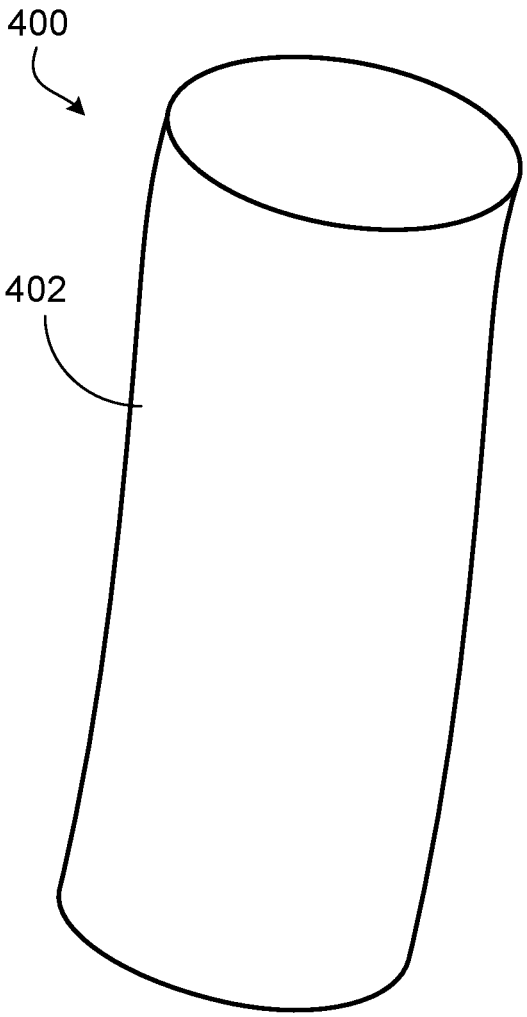
FIG. 4 is a diagram of a polymer sleeve or cylinder to be disposed on or around the expandable metal structure of FIG. 3.

FIG. 4 is an example of an elastomer or polymer 400 mass that may be placed on the expandable metal structure 300 such as metal stent or similar metal structure. As mentioned, the melted polymer 400 may adhere to the borehole (wellbore) wall and causes formation damage by shutting unwanted water due to the presence of the polymer 400 skin against the wellbore wall. At this stage, the metallic structure and the ratchet rings are both generally fixed at the borehole walls. Lastly, as discussed below, the deployed hydraulic arms 202 may be collapsed and released from the ratchet rings 210, and the deploying tool 200 pulled out of hole. Indeed, the deployment setting tool 200 may be retrieved and the undesirable zone (for example, water zone) isolated. Thus, the technique may resolve and implement zonal isolation in a rigless fashion.

In certain embodiments, the polymer 400 may be generally hydrophobic with little thermal resistance to facilitate melting against the formation and once melted, the membrane may be generally non-porous. A purpose of the heating may to accelerate the melting of the polymer 400 material against the formation wall with the polymer 400 material or membrane reach a liquefied state in some examples after heating to adhere to the formation wall asperities. The polymer 400 material chosen may have at least some surface affinity with the rock material to adhere to the rock grains and bond with the formation to achieve the sealing. In some examples, the polymer is a thermoplastic resin or an ethylene-vinyl acetate (EVA) polymer, or a mixture thereof. Of course, the polymer 400 may instead be other polymers, plastics, or elastomers.

Figure 5C:
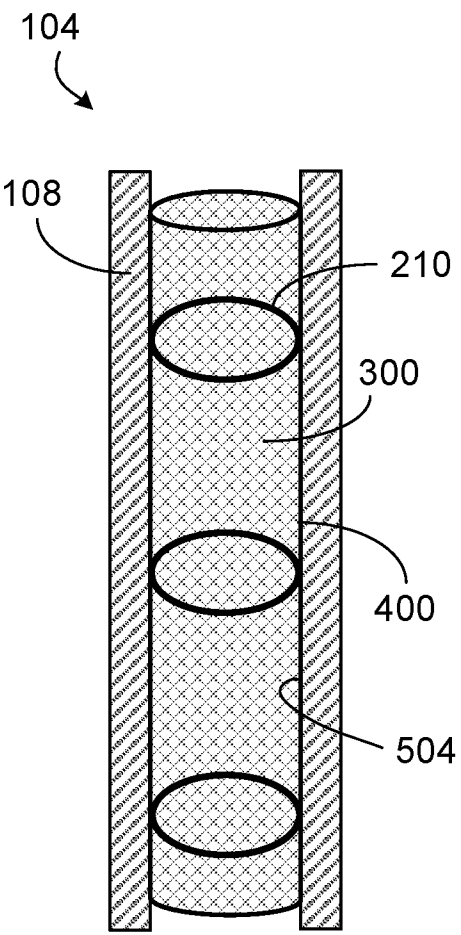
FIG. 5C is a diagram of the wellbore of FIG. 5A and FIG. 5B with a portion of the sealing assembly remaining in the wellbore.
Figure 5B:
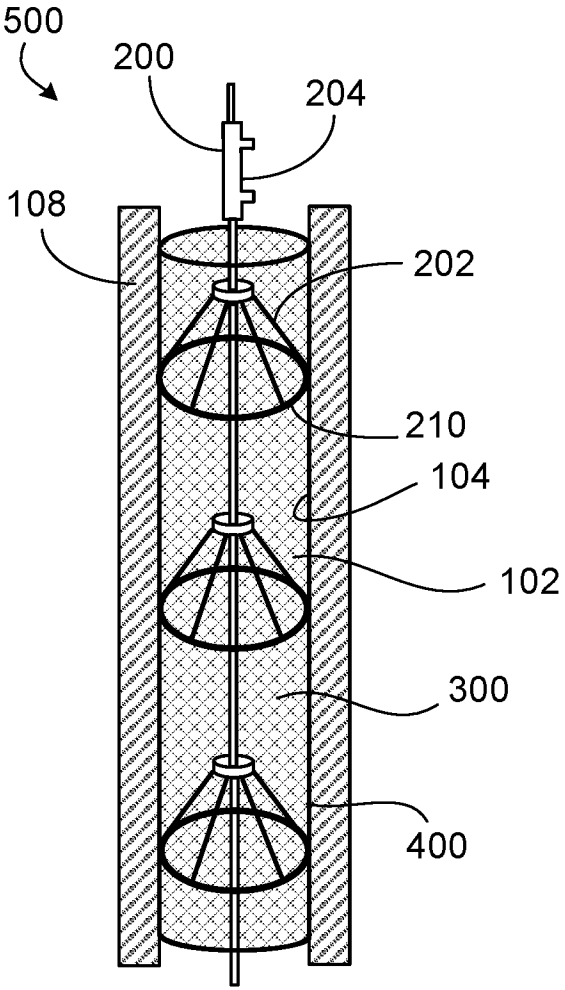
FIG. 5B is a diagram of a sealing assembly of FIG. 5B in an expanded mode deployed into the wellbore.
Figure 5A:
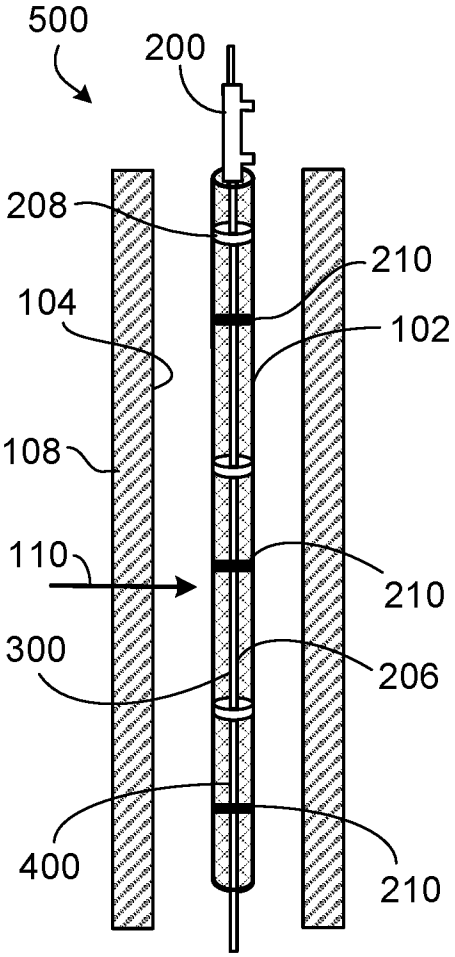
FIG. 5A is a diagram of a sealing assembly in a collapsed mode deployed into a wellbore.

FIGS. 5A-5C are the sealing assembly 102 (see preceding figures) being applied to a wellbore 104 as well intervention. FIGS. 5A and 5B are the sealing assembly 102 as deployed 500 in the wellbore 104. FIG. 5C is the wellbore 104 with installed remnants of the sealing assembly 102 remaining after removal of the setting tool 200 of the sealing assembly 102. In some examples, the wellbore 104 is at least 6⅛ inches openhole. Thus, the expandable metal structure 300 of the sealing assembly 102 may expand to at least approximately 6 inches or 6⅛ inches to isolate an undesirable zone such as a water zone for water shut-off. The metal structure 300, for example as an expendable wire mesh, with a polymer 400 envelope disposed thereon can be deployed via coil tubing or a wireline and expanded to the desired wellbore diameter (for example, 6⅛ inches openhole) to isolate an undesirable zone for water shut-off or other applications.

FIG. 5A is the sealing assembly 102 in a collapsed mode deployed into the wellbore 104. The sealing assembly 102 is lowered into the wellbore 104 and positioned to a target zone (in this case, a particular water zone) of the wellbore 104 in which water 110 enters the wellbore 104 from the hydrocarbon formation 112. The hydrocarbon formation 112 may have permeable sections or fractures at the wellbore 104 water zone that promote or allow flow of fluids such as water 110 into the tubular cavity of the wellbore 104.

The setting tool 200 of the sealing assembly 102, along with coiled tubing or a wireline, may lower the sealing assembly 102 into the wellbore 104 in a rigless operation. Indeed, such may be a rigless deployment of the sealing assembly 102. In FIG. 5A, the hydraulic arms 202 on the circular supports 208 of the setting tool 200 are not extended but instead generally parallel to a vertical central axis of the sealing assembly 102 and setting tool 200. A sealing polymer 400 and underlying metal structure 300 reside on the ratchet rings 210 coupled to the hydraulic arms 202.

FIG. 5B is the sealing assembly 102 in expanded mode in the wellbore 104. Indeed, after being initially deployed (FIG. 5A) into the wellbore 104, the sealing assembly 102 may be expanded, as depicted in FIG. 5B. The sealing assembly 102 may be extended from the collapsed mode (FIG. 5A) to against the wall or surface of the wellbore 104 as shown in FIG. 5B.

In examples, the setting tool 200 as a hydraulic setting tool 200 (for example, having a hydraulic cylinder 204) extends the setting tool arms 202 hydraulically to expand the ratchet rings 210. Indeed, the ratchet rings 210 may reside on and be temporarily coupled to the arms 202. In some embodiments, the hydraulic arms 202 may have joints or extensions to facilitate the hydraulic extension of the arms 202. In certain implementations, the supports 208 of the arms 202 may move or slide, similar to a principle of an umbrella, to facilitate hydraulic extension of the arms 202. In operation, the circular supports 208 may move or slide. For example, the circular supports 208 may slide up and down based on the hydraulic cylinder motion.

Again, the extending of the arms 202 toward the wellbore 104 wall expands the ratchet rings 210 toward the wellbore wall 104. The expanded ratchet rings 210 may hold the flexible metal structure 300 firmly in position when expanded against the wall of the wellbore 104 at the target zone. The number of the transverse ratchet rings 210 may be correlative with the longitudinal length of the target zone to be covered by expandable metal structure 300.

As discussed below with respect to FIG. 6A, one example of a ratchet ring 210 is a toothed ratchet ring in which overlapping teeth in the internal opposed facing sides of overlapped surfaces permit unidirectional expansion. The teeth are generally uniform, but asymmetric, with each tooth having a moderate slope on one side and a steeper slope on the other side. The moderate slope allows the overlapped part to slide during expansion of the ring 210, and the steeper slope prevents the ring from collapsing after expansion. The expandable metal structure 300 may facilitate maintaining the teeth of the ratchet ring 210 aligned, and the expandability of the metal structure 300 allowing expansion of the ring 210 to the inside of the metal structure 300.

In operation, the expanding of the ratchet rings 210 expands the metal structure 300 to press the flexible polymer 400 against the wall of the wellbore 104, as indicated in FIG. 5B. The ratchet rings 210 as expanded may remain expanded or locked in place, such as via teeth, locks, or ratchets of the ratchet rings 210. Moreover, as discussed, the metal structure 300 may be a stent or mesh, and the like. In certain examples, while the ratchet rings 210 may lock or remain expanded to keep the metal structure 200 in an expanded state, the metal structure 300 as a stent may also itself lock or remain in place in the expanded state. For example, the metal structure 300 as a stent or expandable wire mesh may have linkages that lock in place with the metal structure 300 expanded against the wellbore 104 wall.

In operation, electricity or an electrical current may be applied and flow through the setting tool 200 to the expanded metal structure 300 to heat the metal structure 300 to soften or melt the polymer 400 pressed against the wellbore 104 wall. Due to the heat applied via the electrical current and metal structure 300, the polymer 400 may soften or melt. This softening or melting along with force applied by the expanded metal structure 300 may flow the polymer 400 into pores, unconsolidated material, fractures, and the like, in the formation 108 at the wellbore 104 wall to damage, plug, or seal the formation 108. In some examples, the heat may melt the polymer 400 to a liquid or semi-liquid state to promote such flow. The polymer may then harden to plug the formation and isolate the water zone to prevent or reduce the flow of water 110 into the wellbore 104.

In addition to or in lieu of the applying the electrical current, the expanded metal structure 300 (or ceramic particles embedded therein) may be heated via electromagnetic radiation or microwave radiation. In certain implementations, the metal structure 300 may incorporate ceramic particles to promote heating of the polymer 400 via by the microwave radiation. A microwave radiation source such as a microwave radiating tool may be deployed inside the metal structure 300 or expanded mesh wire such as on the setting tool 200, or may be deployed separately from the setting tool 200. In general, microwaves are a form of electromagnetic radiation with wavelengths ranging from one meter to one millimeter, and with frequencies between 300 megahertz (MHz) (100 centimeter or cm) and 300 gigahertz (GHz) (0.1 cm), or between 1 GHz to 100 GHz, 3 GHz to 30 GHz, 110 GHz to 140 GHz or 170 GHz, and so on. In a particular example, the microwave radiation applied is in a range of 2 GHz to 4 GHz (or 7.5 cm to 15 cm).

In the case of ceramic particles embedded in the metallic mesh, the deployment tool 200 may have a microwave heater to radiate microwave energy to the heat the ceramics to melt the polymer 400 cylinder. In examples, the microwave radiation may heat the metal structure 300 to at least 1000° C. The heating may involve dielectric heating, also known as radio-frequency (RF) heating. Ceramic is a dielectric material. Thus, a microwave source could be deployed to heat up ceramic particles embedded in the metal structure 300 or metallic mesh to generate heat to melt the cylindrical polymer 400 and promote adherence of the polymer 400 to the wellbore 104 wall. The polymer 400 may at least partially take the shape of the wellbore 104 borehole wall.

FIG. 5C is the wellbore 104 having the extended ratchet rings 210 supporting the expanded metal structure 300 and plugging polymer 400 against the wellbore 104 wall surface 504 which is at the formation 108. Thus, this section of the wellbore 104 as, for example, a water zone may be damaged to seal or partially-seal and isolate the water zone to prevent or reduce water 110 entry from the formation 108 into the wellbore 104. The setting tool 200 may release the ratchet rings 210 and be removed from the wellbore 104.

Figure 6:
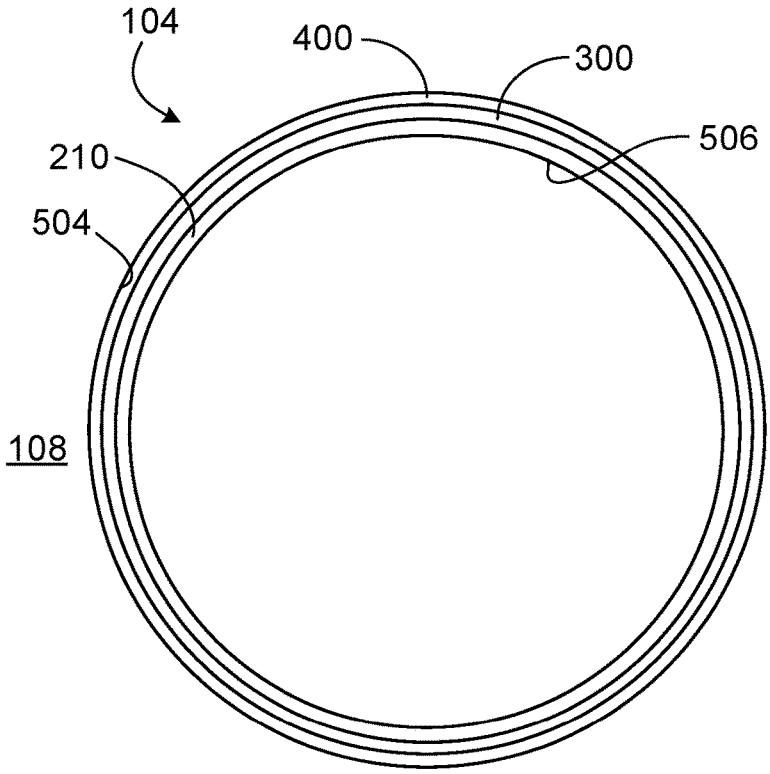
FIG. 6 is a diagrammatical representation of a top cross-section view of the wellbore of FIG. 5C.

FIG. 6 is a simplified representation of top cross-section view of the wellbore 104 of FIG. 5C. In the illustrated embodiment, the wellbore 104 includes a polymer 400 mass pressed into pores or fractures of the formation 108. Initially, as discussed, an example is a polymer 400 sleeve or cylinder that is softened or melted, and then allowed to solidify or harden to plug permeability of the formation 108. The wellbore 104 includes an expanded metal structure 300, such as a stent or mesh, underlying and supporting the polymer 400. In the illustrated embodiment, the polymer 400 is against and in the surface 504 of the formation 108 defining the wellbore 104.

In some implementations, the metal structure 300 may lock into place as expanded. For example, the metal structure 300 as a stent may lock or remain expanded, for instance, via stent internal linkages 302. The underlying ratchet rings 210 may provide additional stability by locking in their expanded state to maintain the metal structure 300 against the polymer 400 and the wellbore 104 wall 502. In other implementations, the metal structure 300 does not itself lock into the expanded state but is maintained in the expanded state, for example, via the underlying ratchet rings 210. The surface of the ratchet rings 210 facing the interior of the wellbore 104 is denoted by the reference numeral 506.

Figure 6A:
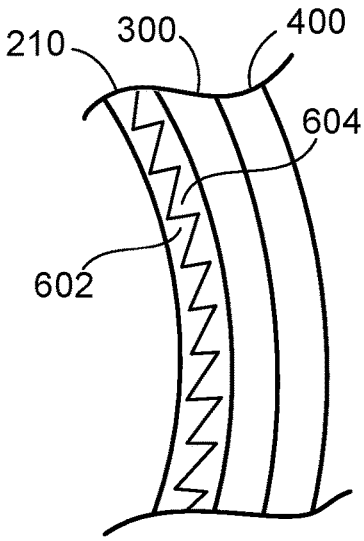
FIG. 6A is a diagrammatical representation of an exploded view of a portion of the wellbore wall of FIG. 6.

FIG. 6A is an exploded view of a portion of the wellbore 104 wall of FIG. 6. As discussed, the wellbore 104 has a polymer 400 layer against and into the formation 108 to beneficially damage and thus plug the formation 108 for the water zone. A metal structure 300, such as a stent, mesh, sheet, and so on, may lock in place and supports or presses against the polymer 400 layer. Ratchet rings 210 toward the wellbore 104 interior support and press against the metal structure 300.

In the illustrated embodiment, the expandable ratchet ring 210 depicted is composed of two metal rings 602, 604, having overlapping teeth on the inner facing sides as best shown in FIG. 6A. The teeth are generally uniform, but asymmetric, with each tooth having a moderate angular slope on one side, and a steeper slope on the other side. The moderate angular slope on one side allows the overlapping teeth to slide over each other during extension of the hydraulic arms 202 and expansion of the metal structure 300. The steeper slope prevents the ring 210 from collapsing after extension of the arms 210, and promotes retaining the metal structure 300 in the expanded configuration. Other configurations of the ratchet rings 210 are applicable.

Figure 7:
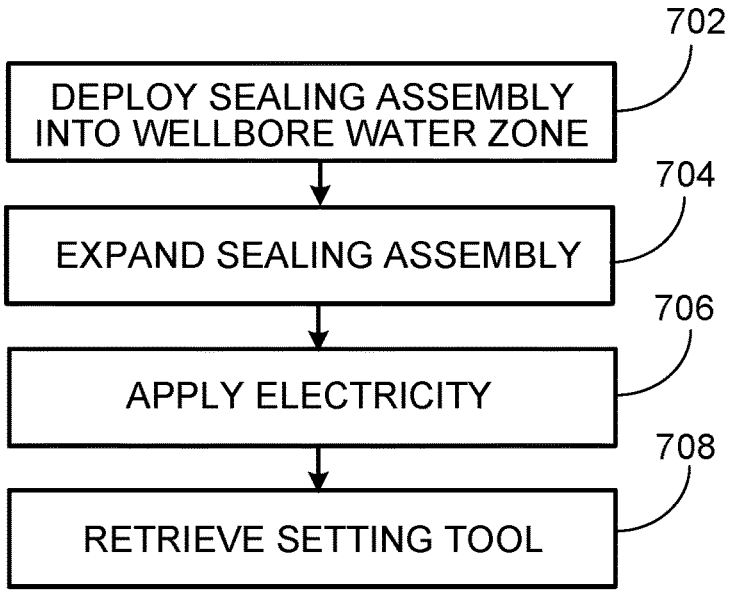
FIG. 7 is a block a method of sealing permeability of a wellbore water zone.

FIG. 7 is a method 700 of sealing permeability of a wellbore water zone. The wellbore may be an open-hole borehole formed in a geological formation or hydrocarbon formation in the Earth crust. The wellbore may be for the exploration or production of hydrocarbons such as crude oil and natural gas. The wellbore water zone may undesirably flow water from the formation into the wellbore, such as through permeability (pores, unconsolidated material, etc.) or fractures in the formation. The source of the water may be in the hydrocarbon formation or an adjacent water aquifer layer in the Earth crust.

At block 702, the method includes deploying a sealing assembly into the wellbore water zone. In some examples, the deployment is rigless with the sealing assembly lowered into the wellbore by coiled tubing or a wireline, and the like. The sealing assembly includes an expandable metal structure and polymer disposed on the expandable metal structure. The expandable metal structure may be or include a stent or mesh, or similar structure. The longitudinal length of the expandable metal structure may depend on the length of the wellbore water zone to be plugged or sealed.

The polymer is disposed on the expandable metal structure to plug permeability of the wellbore water zone. The polymer may be a polymer mass, envelope, cylinder, and the like. In some examples, the polymer is a thermoplastic resin or an ethylene-vinyl acetate (EVA) polymer, or a mixture thereof.

At block 704, the method includes expanding, via a hydraulic cylinder, the expandable metal structure and polymer against the wall of the wellbore water zone. In certain embodiments, the sealing assembly has a setting tool with extendable arms. Ratchet rings may be disposed on the extendable arms. The expandable metal structure may be disposed on the ratchet rings, and with the ratchet rings transverse to the longitudinal surface of the expandable metal structure. See, for example, FIG. 5B. The number of ratchet rings may depend on the longitudinal length of the expandable metal structure. The expanding of the expandable metal structure may involve extending the setting tool arms hydraulically via the hydraulic cylinder to expand the ratchet rings that then expand the expandable metal structure and polymer against the wall of the wellbore water zone.

At block 706, the method includes heating the metal structure as expanded to soften or melt the polymer against the wall of the wellbore water zone. The softened or liquid polymer may fill pores or fractures in the formation at the wellbore. Indeed, the method may include flowing the polymer as melted into unconsolidated material of the formation. The heating may involve applying electricity or an electrical current to the sealing assembly to heat the expandable metal structure to heat the polymer. In addition to or in lieu of applying an electrical current, the heating may include applying microwave radiation to heat the expandable metal structure to heat the polymer. If so, the expandable metal structure may have ceramic particles to promote heating of the polymer or expandable metal structure with the microwave heating. The method may include allowing the melted polymer to solidify or harden to plug or seal the permeability of the formation at the wellbore water zone.

At block 708, the method includes retrieving the setting tool from the wellbore water zone after the polymer hardens and leaving the expandable metal structure and ratchet rings in place. The setting tool may release the ratchet rings. Moreover, in some examples, the ratchet rings may remain expanded via teeth of the ratchet rings. The setting tool may be removed from the wellbore via coiled tubing, a wireline, or a slickline, and the like.

As discussed, (1) the deployment of the sealing assembly, (2) sealing of the undesirable zone of the wellbore, and (3) retrieval of the setting tool may be a rigless operation such as via coiled tubing, a wireline, a slickline, and the like. In the oil and gas industries, coiled tubing generally refers to a metal pipe supplied spooled on a reel. The coiled tubing may be employed for interventions in oil and gas wells. Coiled tubing can be utilized to carry out operations similar to wirelining discussed below. In general, a coiled-tubing operation may involve inserting a flexible steel pipe into a wellbore to convey well servicing tools and to circulate fluids. In examples, the steel coiled tubing may be constructed of strips of steel rolled and seam welded. The tubing may be flexible to be coiled onto a reel, and with diameters in the range, for example, of ¾ inch to 3½ inch, or 1 inch to 3¼ inch.

A wireline may be a solid or braided wire mounted on a powered reel at the surface near the borehole or wellbore. The wireline may be an electric cable, and may be single strand or multi-strand. The wireline surface equipment may include skids (for example, self-contained skid) having the wireline reel, power supply, and associated control and connection equipment. In general in the oil and gas industry, the term wireline may refer to a cabling technology by operators to lower equipment or measurement devices into the well for well intervention, reservoir evaluation, pipe recovery, and so forth.

A slickline which can be up to 35,000 feet or longer may be similar to a wireline. Typically, a slickline may be a thin cable to deliver and retrieve tools downhole, whereas a wireline may more generally be an electric cable to both lower tools and transmit data. In some examples, the slickline may be wrapped around a drum on the back of a truck, and the slickline raised and lowered in the well by reeling in and out the wire hydraulically.

Lastly, certain examples of the present techniques may seal or isolate wellbore zones other than water zones. Another example of a problematic wellbore zone is a thief zone or lost-circulation zone in which drilling fluid (drilling mud) enters the hydrocarbon formation from the borehole or wellbore. In a thief zone, the drilling fluid circulating through the wellbore during drilling operations may unfortunately exit the wellbore into the hydrocarbon formation. The exit of the drilling fluid may be through a cavernous portion or through fractures or permeable portions of a non-cavernous formation. Such may result in lost circulation or partial lost circulation of the drilling fluid. There are other examples of additional types of problematic wellbore zones that benefit from the formation damage and sealing with the techniques discussed herein.

In summary, an embodiment is a sealing assembly for a zone of a wellbore, including a setting tool for rigless deployment of the sealing assembly into the wellbore, the setting tool having extendable arms. The sealing assembly includes ratchet rings disposed on the extendable arms and expandable to a diameter of the wellbore. In some examples, the ratchet rings have teeth for the ratchet rings to remain in an expanded state. Further, the sealing assembly includes an expandable metal structure disposed around the ratchet rings. The expandable metal structure may have linkages for the expandable metal structure to expand and remain in an expanded state. In certain examples, the expandable metal structure is or includes a metal stent or mesh. Moreover, a polymer disposed on the expandable metal structure may plug permeability of the wellbore zone. In examples, the polymer is a thermoplastic resin or ethylene-vinyl acetate (EVA) polymer, or a mixture thereof. In addition, the sealing assembly may include an electricity source to provide electricity to heat the expandable metal structure to melt the polymer to plug the permeability. The sealing assembly may include a microwave radiation source to heat the expandable metal structure to melt the polymer to plug the permeability, wherein the expandable metal structure has ceramic particles. Furthermore, the sealing assembly may include a hydraulic cylinder to hydraulically extend the extendable arms. The setting tool may include the hydraulic cylinder. Lastly, a wireline or coiled tubing coupled to the setting tool for the rigless deployment.

Another embodiment is an oil-well intervention system for a wellbore zone, including a sealing assembly to seal the wellbore zone. The sealing assembly includes a setting tool for rigless deployment of the sealing assembly into the wellbore, the setting tool having hydraulic extendable arms. The sealing assembly includes ratchet rings disposed on the hydraulic arms, the ratchet rings expandable to a diameter of the wellbore zone and to lock in place in an expanded state. The sealing assembly includes an expandable metal structure (for example, stent or mesh) disposed on the ratchet rings. The expandable metal structure may have a lock to lock the expandable metal structure in place in an expanded state. In some examples, the expandable metal structure may include the ratchet rings. The system includes a polymer, such as a flexible polymer sleeve, disposed around an outer surface of the expandable metal structure. A dispenser may provide a deployment extension to couple to the setting tool to facilitate lowering of the sealing assembly into the wellbore zone for the rigless deployment of the sealing assembly. In one example, the deployment extension is coiled tubing, and the dispenser is a coil tubing reel. In another example, the deployment extension is a wireline, and the dispenser is a wireline dispenser such as a wireline truck or reel. An electrical source provides electrical current through the deployment extension to heat the expandable metal structure to melt the flexible polymer to seal permeability in the wellbore zone. The wellbore zone may be a water zone.

Yet another embodiment is a method of sealing permeability of a wellbore water zone. The method includes deploying a sealing assembly into the wellbore water zone, wherein the sealing assembly includes an expandable metal structure (for example, mesh or stent) and polymer disposed on the expandable metal structure. The deploying may be lowering, via coiled tubing or a wireline, the sealing assembly in the wellbore water zone in a rigless operation. Further, the method includes expanding, via a hydraulic cylinder, the expandable metal structure and polymer against a wall of the wellbore water zone. Further, the method includes heating the expandable metal structure as expanded to melt the polymer against the wall of the wellbore water zone. The heating may include applying electricity to the sealing assembly to heat the expandable metal structure. The heating may include applying electromagnetic radiation to heat the expandable metal structure, and wherein the expandable metal structure incorporates ceramic particles. The method may include allowing the polymer as melted to flow into a formation defining the wellbore water zone and to harden to seal the permeability. The sealing assembly may include a setting tool and ratchet rings disposed on arms of the setting tool, wherein the expandable metal structure is disposed on the ratchet rings, and wherein expanding sealing assembly includes extending the arms to expand the ratchet rings to expand the expandable metal structure and polymer against the formation. The method may include releasing the ratchet rings from the setting tool arms, retrieving (via coiled tubing, a wireline, or a slickline) the setting tool from the wellbore water zone after the polymer hardens, and leaving the expandable metal structure and the ratchet rings in place. In a particular example, the method maintains the ratchet rings expanded via teeth of the ratchet rings.

A number of implementations have been described. Nevertheless, it will be understood that various modifications may be made without departing from the spirit and scope of the disclosure.

What is claimed is:

1. A sealing assembly for a zone of a wellbore, comprising:

a setting tool for rigless deployment of the sealing assembly into the wellbore, the setting tool comprising extendable arms;

ratchet rings disposed on the extendable arms, the ratchet rings expandable to a diameter of the wellbore;

an expandable metal structure disposed around the ratchet rings; and polymer disposed on the expandable metal structure to plug permeability of the wellbore zone, the expandable metal structure to receive electricity from an electricity source to heat the expandable metal structure to melt the polymer to plug the permeability.

2. The sealing assembly of claim 1, wherein the polymer comprises a thermoplastic resin or an ethylene-vinyl acetate (EVA) polymer, or a mixture thereof.

3. The sealing assembly of claim 1, wherein the expandable metal structure comprises a metal stent.

4. The sealing assembly of claim 1, wherein the ratchet rings comprise teeth to remain in an expanded state.

5. The sealing assembly of claim 1, wherein the expandable metal structure comprises linkages for the expandable metal structure to expand and remain in an expanded state.

6. The sealing assembly of claim 1, comprising a hydraulic cylinder to hydraulically extend the extendable arms.

7. The sealing assembly of claim 6, wherein the setting tool comprises the hydraulic cylinder.

8. The sealing assembly of claim 1, comprising a wireline or coiled tubing coupled to the setting tool for the rigless deployment.

9. A sealing assembly for a zone of a wellbore of claim 2, comprising:

a setting tool for rigless deployment of the sealing assembly into the wellbore, the setting tool comprising extendable arms;

ratchet rings disposed on the extendable arms, the ratchet rings expandable to a diameter of the wellbore;

an expandable metal structure disposed around the ratchet rings;

polymer disposed on the expandable metal structure to plug permeability of the wellbore zone; and a microwave radiation source to heat the expandable metal structure to melt the polymer to plug the permeability, wherein the expandable metal structure comprises ceramic particles.

10. An oil-well intervention system for a wellbore zone, comprising:

a sealing assembly to seal the wellbore zone, comprising:

a setting tool for rigless deployment of the sealing assembly into the wellbore, the setting tool comprising hydraulic extendable arms;

ratchet rings disposed on the hydraulic arms, the ratchet rings expandable to a diameter of the wellbore zone and to lock in place in an expanded state;

an expandable metal structure disposed on the ratchet rings; and polymer disposed around an outer surface of the expandable metal structure, the expandable metal structure to receive electrical current through a deployment extension from an electrical source to heat the expandable metal structure to melt the flexible polymer to seal permeability in the wellbore zone.

11. The oil-well intervention system of claim 10, comprising a dispenser to provide the deployment extension to couple to the setting tool to facilitate lowering of the sealing assembly into the wellbore zone for the rigless deployment of the sealing assembly.

12. The oil-well intervention system of claim 11, wherein the deployment extension comprises coiled tubing, and wherein the dispenser comprises a coil tubing reel.

13. The oil-well intervention system of claim 11, wherein the deployment extension comprises a wireline, and wherein the dispenser comprises a wireline dispenser.

14. The oil-well intervention system of claim 10, wherein the expandable metal structure comprises a stent or mesh, and wherein the wellbore zone comprises a water zone.

15. A method of sealing permeability of a wellbore water zone, comprising:

deploying a sealing assembly into the wellbore water zone, wherein the sealing assembly comprises an expandable metal structure and polymer disposed on the expandable metal structure;

expanding, via a hydraulic cylinder, the expandable metal structure and polymer against a wall of the wellbore water zone; and heating the expandable metal structure as expanded to melt the polymer against the wall of the wellbore water zone, wherein heating comprises applying electricity to the sealing assembly to heat the expandable metal structure.

16. The method of claim 15, comprising allowing the polymer as melted to flow into a formation defining the wellbore water zone and to harden to seal the permeability.

17. The method of claim 16, wherein the sealing assembly comprises a setting tool and ratchet rings disposed on arms of the setting tool, wherein the expandable metal structure is disposed on the ratchet rings, and wherein expanding comprises extending the arms to expand the ratchet rings to expand the expandable metal structure and polymer against the formation.

18. The method of claim 17, comprising:

releasing the ratchet rings from the setting tool arms;

retrieving, via coiled tubing, a wireline, or a slickline, the setting tool from the wellbore water zone after the polymer hardens; and leaving the expandable metal structure and the ratchet rings in place after the polymer hardens.

19. The method of claim 17, comprising maintaining the ratchet rings expanded via teeth of the ratchet rings.

20. The method of claim 15, wherein deploying comprising lowering, via coiled tubing or a wireline, the sealing assembly in the wellbore water zone in a rigless operation.

21. The method of claim 15, wherein the expandable metal structure comprises a stent or mesh.

22. A method of sealing permeability of a wellbore water zone, comprising:

deploying a sealing assembly into the wellbore water zone, wherein the sealing assembly comprises an expandable metal structure and polymer disposed on the expandable metal structure;

expanding, via a hydraulic cylinder, the expandable metal structure and polymer against a wall of the wellbore water zone; and heating the expandable metal structure as expanded to melt the polymer against the wall of the wellbore water zone, wherein heating comprises applying electromagnetic radiation to heat the expandable metal structure, and wherein the expandable metal structure comprises ceramic particles.

* * * * *